United States Patent [19]

Wagner

[11] Patent Number: 4,535,978

[45] Date of Patent: Aug. 20, 1985

[54] COIL SPRING AND SPRING ASSEMBLY

[75] Inventor: Robert F. Wagner, Lombard, Ill.

[73] Assignee: Sealy, Incorporated, Chicago, Ill.

[21] Appl. No.: 321,798

[22] Filed: Nov. 16, 1981

Related U.S. Application Data

[63] Continuation of Ser. No. 142,851, Apr. 21, 1980, abandoned, which is a continuation-in-part of Ser. No. 923,771, Jul. 12, 1978, abandoned.

[51] Int. Cl.[3] ..... F16F 1/12

[52] U.S. Cl. ..... 267/91; 5/256; 5/269; 5/475

[58] Field of Search ..... 267/91, 92, 93, 94, 267/95, 96, 97, 98, 99, 100, 101, 103, 61 R, 61 S, 166, 167, 170, 178, 179, 180; 5/248, 256, 269, 475

[56] References Cited

U.S. PATENT DOCUMENTS

| | | | |
|---|---|---|---|
| 1,744,389 | 1/1930 | Karr | 5/269 |
| 1,798,885 | 3/1931 | Karr | 5/269 |
| 1,879,172 | 9/1932 | Gail | 5/269 |
| 1,895,429 | 1/1933 | Foster | 5/269 |
| 1,907,541 | 5/1933 | Heuer | 5/269 |
| 1,913,353 | 6/1933 | Hager et al. | 5/269 |
| 1,938,489 | 12/1933 | Karr | 5/269 |
| 1,977,476 | 10/1934 | Hager et al. | 5/269 |
| 2,516,566 | 7/1950 | Hager | 5/269 |
| 3,660,854 | 5/1972 | Garceau | 5/267 |
| 3,789,440 | 2/1974 | Garceau | 5/256 |
| 3,958,610 | 5/1976 | Garceau | 140/3 CA |

FOREIGN PATENT DOCUMENTS

| | | | |
|---|---|---|---|
| 222669 | 1/1958 | Australia | 267/91 |
| 2131420 | 4/1971 | Fed. Rep. of Germany . | |
| 1594984 | 7/1970 | France . | |
| 244416 | 7/1979 | Spain . | |
| 244370 | 7/1979 | Spain . | |
| 522085 | 6/1940 | United Kingdom . | |
| 586205 | 1/1946 | United Kingdom . | |
| 708781 | 5/1954 | United Kingdom | 267/101 |
| 807194 | 1/1959 | United Kingdom | 5/256 |

*Primary Examiner*—George E. A. Halvosa
*Attorney, Agent, or Firm*—Willian Brinks Olds Hofer Gilson & Lione Ltd.

[57] ABSTRACT

A spring assembly for an innerspring unit, particularly an innerspring mattress, is provided wherein at least a pair of springs are restricted about their adjacent offset portions of adjacent terminal convolutions in one surface of the assembly so that hinging action between the adjacent offset portions is allowed only to a maximum angle of deflection between the offset portions and thereafter, upon further loading, the pair of springs provide a greater resistance to loading than would be realized without restriction of their adjacent offset portions. Also provided is an improved coil spring for such a spring assembly.

15 Claims, 13 Drawing Figures

FIG. 1
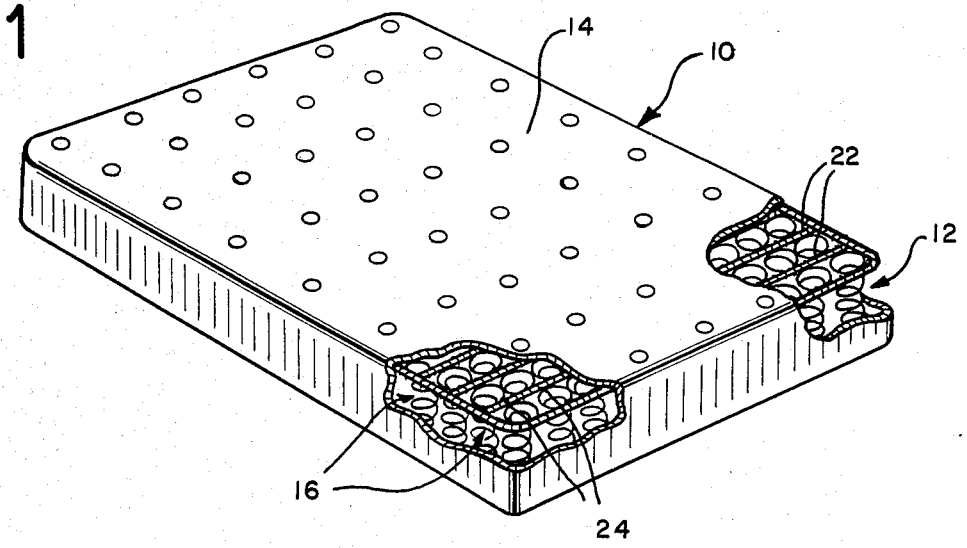
FIG. 2
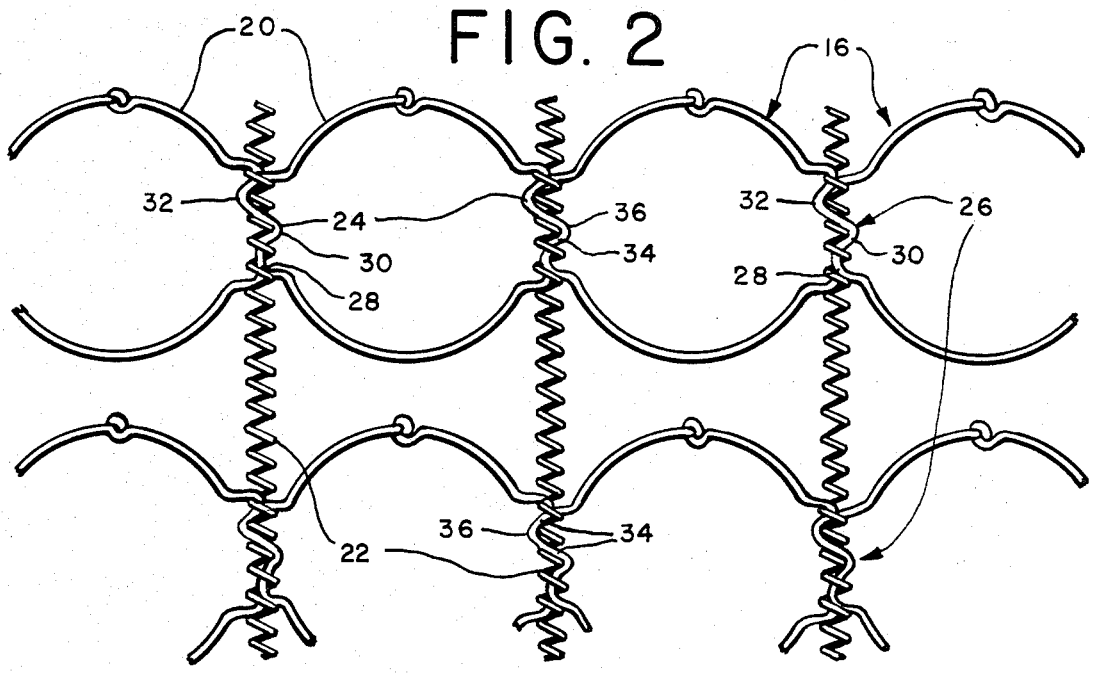
FIG. 3
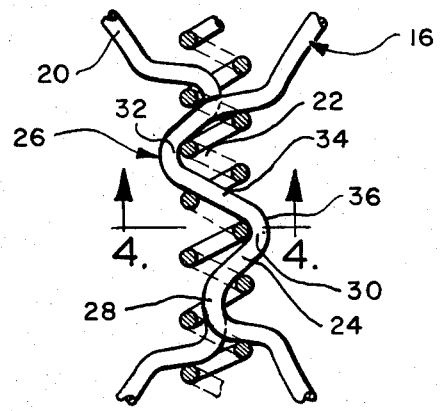
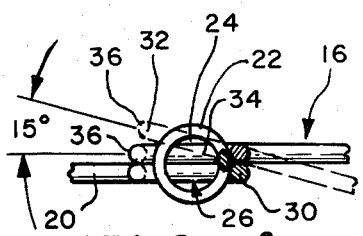
FIG. 4

FIG. 10
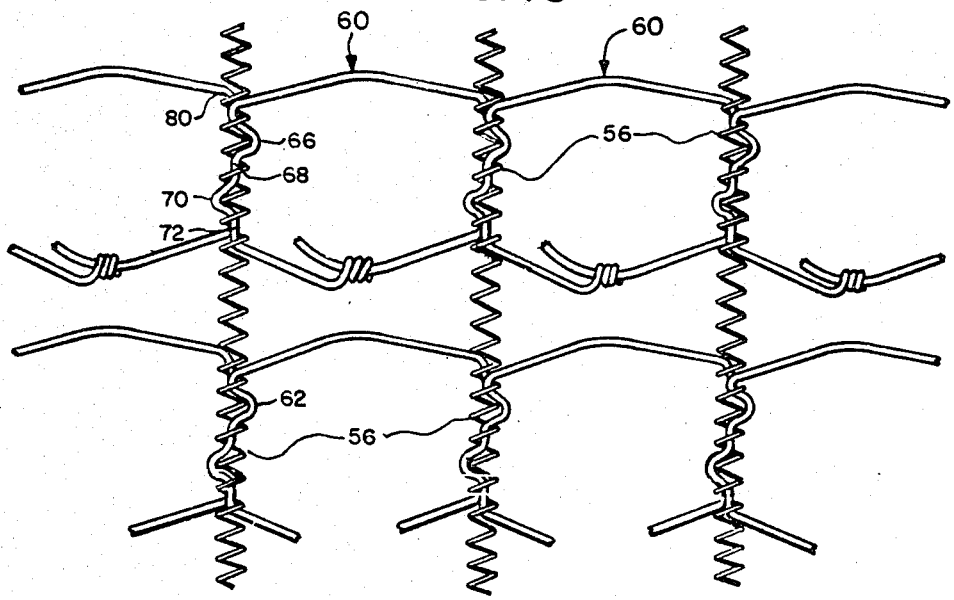
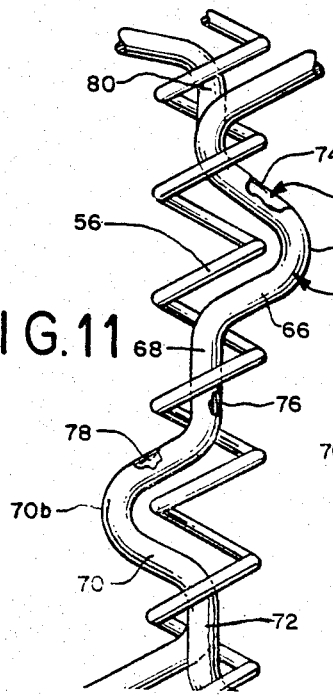
FIG. 11
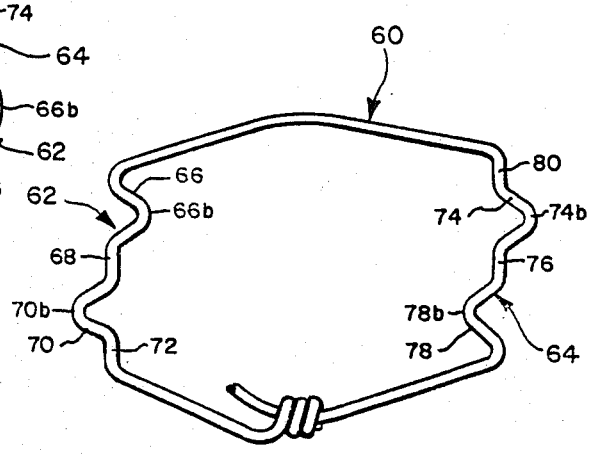
FIG. 12

COIL SPRING AND SPRING ASSEMBLY

This application is a continuation of U.S. patent application Ser. No. 142,851, filed on Apr. 21, 1980, now abandoned. Application Ser. No. 142,851 was a continuation-in-part application of U.S. patent application Ser. No. 923,771,filed on July 12, 1978, now abandoned.

TECHNICAL FIELD OF THE INVENTION

The present invention is directed toward an improved spiral coil spring for a spring assembly, which assembly can be incorporated into an innerspring mattress or other innerspring units. The present invention is also directed toward an improved spring assembly for an innerspring mattress, or other innerspring units, which assembly includes at least one pair of the improved spiral coil springs.

BACKGROUND OF THE INVENTION

An innerspring mattress, or other innerspring unit, generally includes a spring assembly having a plurality of spiral coil springs having a plurality of spring convolutions and arranged in a plurality of substantially parallel rows. The springs of each row are generally interconnected to their adjacent springs by lacing the springs together with cross helicals. Cross helicals are spiral coils of substantially lesser cross-sectional diameter than the spiral coil springs. The cross helicals extend transversely of the rows of the coil springs, in both the upper and lower surfaces of the unit, and lace about the end, or terminal, convolutions of adjacent coil springs.

Terminal convolutions of coil springs generally can be closed loops formed with two opposed offset portions. Coil springs formed with offset portions, such as U-shaped offset portions, on their terminal convolutions are disposed in a spring assembly so that the offset portions are adjacent one another in each row. The cross helicals then lace about adjacent offset portions.

It is desirable to provide innerspring units that conform to the shape of a supported body. Innerspring units containing coil springs which are laced together about offset portions generally have a greater conformance to a supported body than units having springs without such offset portions. The spring conformance is attributable, at least in part, to the hinging action between laced-together offset portions.

Conventional U-shaped offset portions are encircled by a cross helical about the base of the "U". The encircled bases of adjacent offset portions lie within the circumference of the cross helical, substantially parallel to the cross helical's principal axis. Although the offset portions are thus disposed in close proximity, an extensive amount of hinging action between offset portions is allowed; the bases can move past one another. This hinging action allows each coil spring to be compressed somewhat independently of its adjacent springs. The innerspring unit thus conforms to the shape of a supported body or other load.

It is also desirable to provide an innerspring unit having a great degree of firmness. Firmness can be defined as the extent of coil spring compression versus the applied load. Firmness of a unit is dependent upon many variables, such as the unit's coil count (number of coils per unit surface area) and the coil stiffness. For a given unit, raising the coil count or substituting stiffer, less resilient coil springs will decrease the extent of spring compression versus the applied load, but will generally increase the expense of manufacturing such unit.

Another method for increasing the firmness of an innerspring unit, described in U.S. Pat. No. 3,653,082, is to crimp or compress the cross helicals about the offsets of coil springs at the longitudinal side borders of the unit. The crimping frictionally engages the cross helicals to the encircled offsets, restricting the hinging action between the interconnected offsets and therefore between adjacent coil springs. This last method, however, can reduce the extent of hinging action and thus reduce spring conformation to the shape of a supported body.

It is desirable that an innerspring unit, particularly a mattress innerspring unit, be both firm and have a high degree of body conformation, without one characteristic being significantly sacrificed for the other. It is desirable to optimize the firmness and the body conformation characteristics of an innerspring unit without adding substantially to the manufacturing expense for such unit. It is also desirable to provide varying degrees of firmness and body conformation to different portions of an innerspring unit, for instance, more firmness to the longitudinal side borders and more body conformation to the center or end portions. It may also be desirable to provide additional firmness at other regions of an innerspring unit, such as the longitudinal mid-region of a very wide mattress.

It is therefore an object of the present invention to provide an improved spiral coil spring and a spring assembly containing such coil springs, which is firmer than units having conventional spring offsets and yet has the desired degree of body conformation. It is also an object of the invention to provide a spring assembly with improved coil springs in which spring conformation and firmness characteristics are optimized without substantially increasing the cost of the unit.

DISCLOSURE OF THE INVENTION

The foregoing and other objects are realized in accordance with the invention by providing spiral coil springs with offset portions that allow hinging action between adjacent coil springs to a predetermined degree and thereafter, upon further loading, transfer a part of the pressure to the surrounding springs, providing a greater resistance to the load, i.e. greater firmness. The present invention also provides a spring assembly with at least some of its coil springs having such offset portions to optimize both the characteristics of spring conformation and firmness.

The improved spiral coil springs each have at least one offset portion, on at least one of its two terminal convolutions, that has alternating projections forming a sinuous or serpentine configuration or segmented serpentine configuration, comprising at least two offset segments, each formed of a base and an apex, the base being formed by two legs diverging from the apex. When the offset portion approaches a sinuous configuration, the leg of one base terminates at the beginning of the adjacent leg of the adjacent base. A spring assembly of the invention includes at least a pair of such coil springs positioned adjacent one another so that the offset segments of their adjacent offset portions are disposed in overlying relationship, substantially superimposed on one another.

The offset segments preferably extend beyond the circumference of a means for restricting pivotal movement between offset portions, such as an encircling cross helical. Such offset portions are free to hinge relative one another until a maximum deflection angle between the planes of the offset portions is reached. The maximum deflection angle is dependent upon the dimensions of the offset segments and the internal diameter of the encircling cross helical.

When that maximum deflection angle is reached, hinging action between the springs is retarded by the cross helical, and loading pressure on one of the coil springs will be partially transferred to the other coil spring. This transference of loading pressure results in a lessening of spring compression relative to the amount of load. Greater firmness is therefore provided without sacrificing the desirable amount of a hinging action between springs and therefore the conformation characteristic of the unit.

The coil springs of the invention, when laced together by cross helicals, can be considered restricted pairs of coil springs, or springs having restricted pairs of adjacent offset portions.

The offset segments lie substantially in the same plane as the other portions of the spring's terminal convolution. A pair of coil springs restricted with a cross helical will have at least two pairs of substantially contiguous apexes lying to opposed sides of the cross helical. If pressure is applied to either of the coil springs of a restricted pair, the inward-most apex of the overlying offset portion will be prevented from substantial movement downward by the underlying apex of the other coil spring, while its outward-most apex will move in an upward arc until the legs of the offset segments are restricted by the encircling cross helical. Thereafter, further loading pressure will be partially transferred to the other coil springs, lessening the extent of compression of the loaded coil spring per amount of load. A similar but opposite action occurs when pressure is applied between coil springs of a restricted pair.

In a preferred embodiment, terminal convolutions will be formed with two opposed offset portions as described above. Moreover, a coil spring may be formed with both of its terminal convolutions so configured.

The invention and its objects, method of operation, features, and advantages will be more fully understood by reference to the following drawings and detailed description.

DESCRIPTION OF THE DRAWINGS

FIG. 1 is partially cut-away perspective view of a mattress having an innerspring unit embodying the features of the present invention;

FIG. 2 is a fragmentary top plan view of the innerspring unit of FIG. 1 embodying the features of the present invention, FIG. 3 is an enlarged fragmentary top plan view of the innerspring unit of FIG. 1;

FIG. 4 is a cross-sectional side view of the innerspring unit of FIG. 1, taken along line 4—4 of FIG. 3;

FIG. 10 is a partial top plan view of an innerspring unit embodying preferred features of the present invention;

FIG. 11 is an enlarged partial top plan view of the embodiment shown in FIG. 10; and FIG. 12 is a top plan view of a preferred coil spring of an innerspring unit of the present invention.

PREFERRED EMBODIMENTS OF THE DRAWINGS

Figure 3A:
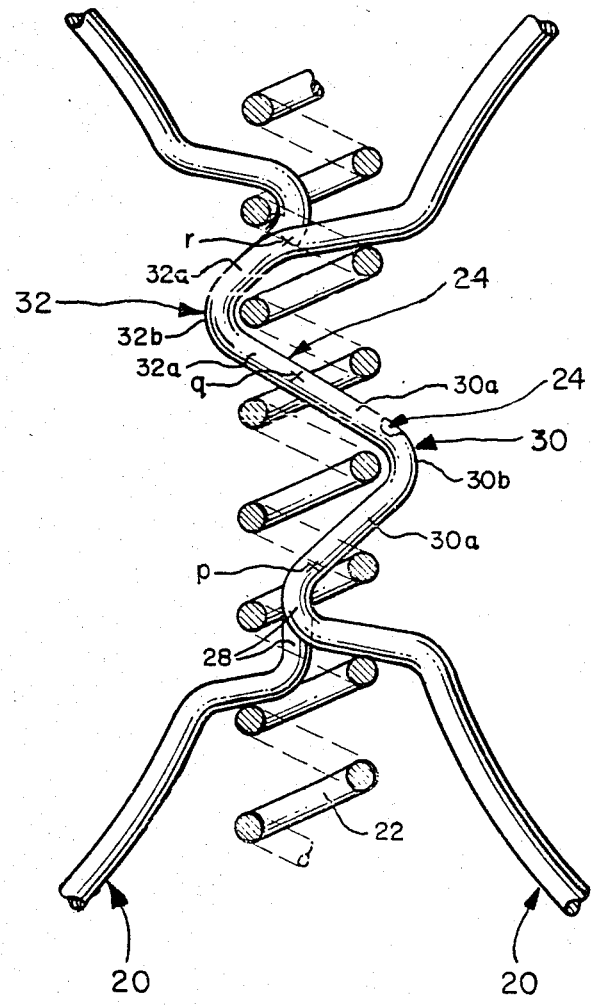
FIG. 3*a* is an enlargement of the top plan view of FIG. 3.
Figure 5:
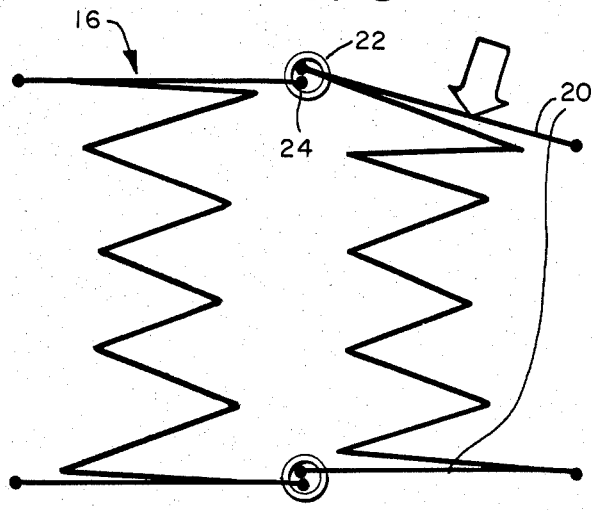
FIG. 5 is a diagrammatic side view of two interconnected coil springs of the innerspring unit of FIG. 1.
Figure 7:
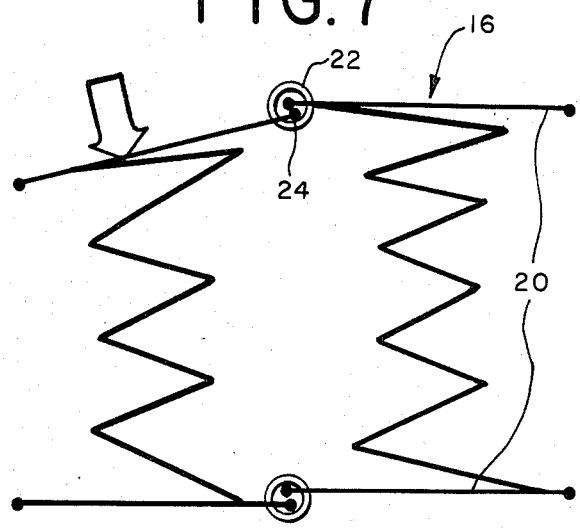
FIG. 7 is a diagrammatic side view of two interconnected coil springs of the innerspring unit of FIG. 1.
Figure 6:
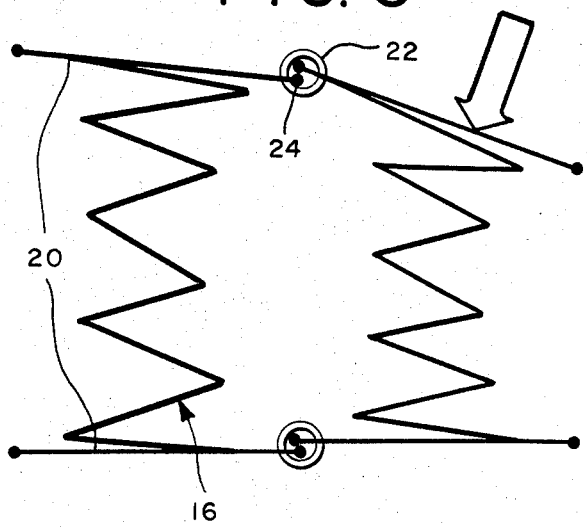
FIG. 6 is a diagrammatic side view of two interconnected coil springs of the innerspring unit of FIG. 1.
Figure 8:
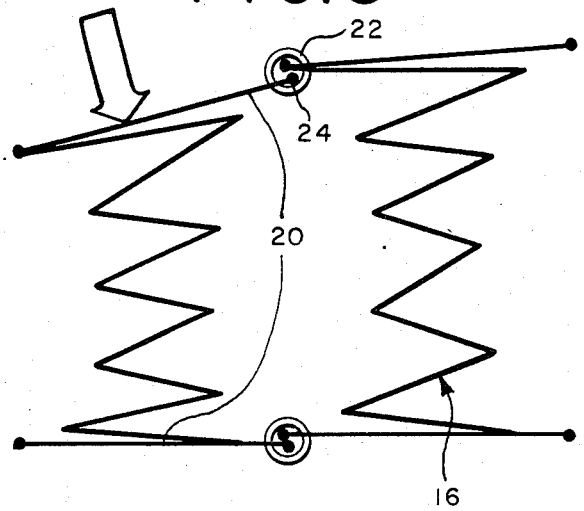
FIG. 8 is a diagrammatic side view of two interconnected coil springs of the innerspring unit of FIG. 1.

Referring now to the drawings, particularly FIG. 1, there is illustrated a mattress embodying the features of the present invention, indicated generally by the reference numeral 10. The mattress 10 is an innerspring unit having a coil spring assembly, designated generally by the reference numeral 12, which is enclosed in a suitable mattress cover 14. The spring assembly 12 includes a plurality of spiral coil springs, designated by the reference numeral 16, which springs 16 are aligned in a plurality of rows extending longitudinally, or head-to-foot, of the mattress 10. Each spiral coil spring 16 is formed of a series of convolutions ending in end, or terminal, convolutions 20 that form the upper and lower surfaces of the unit 12. Each coil spring 16 is interconnected to adjacent coil springs 16 in the same row by cross helicals 22 which lace about the terminal convolutions 20. The cross helicals 22 extend transversely of the assembly 12, across the rows of coil springs 16.

In one embodiment of the invention, illustrated in FIG. 1 and shown in more detail in FIG. 2, each coil spring 16 of the assembly 12 is a member of a restricted pair formed with each adjacent coil spring 16 in the same row in both surfaces of the assembly 12. The cross helicals 22, as will be explained in detail below, are means for restricting hinging action between restricted pairs of coil springs 16. Such overall use of the restricting means of the present invention is, of course, optional. Any number of pairs of coil springs 16, in any position or pattern of positions, and in either or both surfaces of the assembly 12, may be restricted as disclosed herein, or left unrestricted, and selection of suitable portions of an assembly 12 for use of the restricting means is within the skill of a person with ordinary skill in the art. Moreover, no such arrangement can be designated as preferred without reference to the degree, and extent, of firmness and conformation desired.

Each terminal convolution 20, as shown, is formed with two opposed offset portions 24 which are encircled by the cross helicals 22. Cross helicals 22 are a preferred means for restricting hinging action between pairs of coil springs 16 by restricting movement of the offset portions 24 because cross helicals 22 then retain their other normal functions in innerspring construction. (Cross helicals 22 generally both lace together all adjacent pairs of coil springs 16 in the same row and bridge adjacent rows.) Other restricting means, however, can be used, such as clips or helixes or tie wires that can lace together or encircle portions of adjacent terminal convolutions 20.

The cross helicals 22 restrict movement of adjacent offset portions 24, relative to one another, to a maximum deflection angle. When the maximum deflection angle is reached, hinging action between springs 16 is retarded or restricted. The rate of transference of loading pressure from one coil spring 16 to adjacent coil springs 16 upon increased loading will increase abruptly when the maximum angle of deflection is reached, increasing the firmness of the assembly 12. The hinging action allowed between springs 16 before the maximum deflection angle is reached is, however, sufficient to provide a desirable amount of spring conformation to a supported body.

Referring now particularly to FIG. 2, the spiral coil springs 16 of the spring assembly 12 are arranged in a plurality of rows that extend longitudinally, or head-to-foot, of the mattress 10. Adjacent coil springs 16 in each row are sufficiently close to one another so that their adjacent offset portions 24 at least partially overlap. The cross helicals 22 extend transversely of the assembly 12, from one longitudinal side of the mattress 10 to the other, and lace about, or encircle, portions of the overlapped offset portions 24 of pairs of coil springs 16 in each row.

Each coil spring 16 has a terminal convolution 20 at both of its opposite ends. The terminal convolutions 20 of the coil springs 16 collectively form both the upper and lower surfaces of the spring assembly 12. The cross helicals 22 lace together the offset portions 24 of the coil springs 16 in both the upper and lower surfaces of the assembly 12 in the same manner. For simplicity and clarity, only one of the two opposed terminal convolutions 20 of the coil springs 16 are illustrated and the opposite terminal convolutions 20 can be considered identical.

Referring now to FIGS. 3 and 4 also, the offset portions 24 of the terminal convolutions 20 are formed with offset segments, designated generally 26. Each offset segment 26 is that segment of the offset portion 24 which begins and ends about at a point aligned with the principal axis of the encircling cross helical 22, and which juts out from the alignment with the axis. (As shown in FIGS. 2 and 3, each offset portion 24 has two oppositely-extending offset segments 26.)

Each terminal convolution 20, including its opposed offset portions 24, lies substantially in a single plane. Adjacent coils springs 16 are disposed with their adjacent offset portions 24, and thus their adjacent offset segments 26, at least partially overlapped. Although other arrangements can be envisioned, each coil spring 16 is preferably positioned so that one of its offset portions 24 of a given terminal convolution 20 overlies the offset portion 24 of the adjacent coil spring 16, and its other offset portion 24 underlies the offset portion 24 of the opposite adjacent coil spring 16.

The offset portions 24 are preferably formed so as to include a side stabilizing segment 28, a first offset segment 30, and a second offset segment 32. The first and second offset segments 30, 32 extend in opposite directions relative to one another, i.e., diverge or are offset on opposite sides of the principal axis of the encircling cross helical 22. If the offset portions 24 are first envisioned as having conventional U-shaped configurations, the offset segments 26 deviate from this U-shaped configuration by having at least the first and second offset segments 30, 32 being offset on opposite sides of the base of the hypothetical U-shaped offset. The side stabilizing segment 28 follows the base of the hypothetical U-shaped offset. The cross helical 22 encircles a pair of overlapped offset portions 24 so that the side stabilizing segments 28 lie within its circumference, substantially aligned with the cross helical's principal axis, and portions of both the first and second offset segments 30, 32 are outside of its circumference. This construction and its effect will be described in detail below.

Each first and second offset segment 30, 32 of each of the adjacent terminal convolutions 20 are formed of a pair of legs diverging from an apex to form a base which can be considered to end about where the legs reach the principal axis of the encircling cross helical 22. (The bases are thus disposed in an alignment transverse to the rows of coil springs 16 and substantially aligned with the principal axis of the encircling cross helical 22.) The embodiment shown in FIGS. 2 and 3 has an overlying terminal convolution 20 formed with the offset segments 30, 32 continuing into each other. Referring specifically to the enlargement shown in FIG. 3*a*, the legs 30*a* of the first offset segment 30 begin at the apex 30*b* of the first offset segment 30, diverge therefrom, and terminate at a point at least substantially aligned with the principal axis of the cross helical 22, points designated as p and q in FIG. 3*a*. The legs 32*a* of the second offset segment 32 begin at the apex 32*b*, diverging therefrom, and terminating at points substantially aligned with the principal axis of the cross helical 22, points designated as q and r in FIG. 3*a*. Thus, one leg 30*a* of the first offset segment 30 ends at the point one leg 30*a* of the second offset segment begins, i.e., point q.

The terminal convolution 20 of the underlying offset portion 24 has offset segments 26 substantially following those of the overlying offset portion 24. Thus, a first offset segment 30, with legs 30*a* converging to an apex 30*b*, underlies the overlying first offset segment 30, and a similar second offset segment 32 underlies the overlying second offset segment 32. In the preferred embodiment shown in FIGS. 2, 3, and 3*a*, side stabilizing members 28 are found in both the underlying and overlying offset portions 24, and they begin where legs 30*a* of the first offset segments 30 terminate at point p. The overlying and underlying apexes 30*b*, 32*b* of the respective offset segments 30, 32 form two contiguous pairs of apexes, i.e., they meet at a point, which will form a pivot point, although, as will be explained in detail below, at times the apexes in a pair will be spaced apart.

The two opposed offset portions 24 of adjacent terminal convolutions 20 can be formed to resemble superimposable mirror images of one another. The first and second offset segments 30, 32 of one coil spring 16 can be formed to substantially coincide, along substantially their entire length, with the first and second offset segments 30, 32 of the adjacent coil spring 16. Adjacent, overlapped offset portions 24 are then substantially superimposed on one another. In any instance, however, the legs 30*a*, 30*b* of overlying and underlying offset segments 30, 32 converge so as to provide contiguous pairs of overlying and underlying apexes for each pair of overlying and underlying offset segments.

Referring now to FIGS. 5, 6, 7, and 8 also, when a coil spring 16 is subjected to loading, i.e., compressed, its offset portions 24 will hinge relative to the offset portions 24 of the adjacent springs 16. More specifically, the overlying offset portion 24, when its coil spring 16 is compressed, will begin to rotate. Its first offset segment 30, whose apex 30*b* is disposed on the same side of the cross helical 22 as the respective coil spring 16, will be substantially prevented from downward movement by the underlying first offset segment 30 of the underlying offset portion 24. The overlying apex 32*b* of the overlying second offset segment 32 moves in an upward arc. The overlying offset portion 24 thus pivots, relative to the underlying offset portion 24, about the contiguous pair of first apexes 30*b* which together form a pivot point. The planes of these overlapped offset portions 24, which are substantially parallel to one another when the springs 16 are under zero load, will form an angle, the angle of the deflection.

In a similar manner, when the coil spring 16 having the underlying offset portion 24 is compressed, its first offset segment 30 is prevented from movement upward by the overlying first offset segment 30 of the overlying offset portion 24. The underlying offset portion 24 rotates relative to the overlying offset portion 24, moving in a downward arc about the pivot point of the contiguous first apexes 30*b*. Again, the planes of the offset portions 24 will move from a relatively parallel position to form an angle of deflection. The above two explanations presume, for simplicity, that compression of one spring 16 creates no disturbance in the other spring 16 until the maximum angle of deflection is reached. In fact, since adjacent springs 16 are tied together, both the underlying and overlying offset portions 24 are rotating, at least to some extent, from their zero load dispositions.

When the springs 16 are subject to loading about their area of interconnection, i.e., when loading center is about mid-way between coil springs 16, the offset portions 24 again move arcuately relative to each other. The pivot point, however, is the pair of contiguous second apexes 32*b*. For the overlying offset portion 24, the second apex 32*b* is disposed on the side of the encircling cross helical 22 opposite its respective coil spring 16.

This arcuate movement of one offset portion 24 relative its adjacent offset portion 24 upon loading at the coil springs 16 is a hinging action between the adjacent springs 16. The hinging action provides a degree of independent spring compression, allowing the spring assembly 12 generally to conform to the shape of a reclined body. This conformation characteristic of the spring assembly 12 provides a desirable degree of comfort to a body reclined thereon. If total hinging action was allowed, however, by allowing an unrestricted angle of deflection, an innerspring unit such as the mattress 10 would be less firm, for a given coil count and coil stiffness, than the mattress 10 incorporating the spring assembly 12 of the present invention. The coil springs 16 of the spring assembly 12 are not allowed a complete hinging action; the hinging action is allowed only until a predetermined, maximum deflection angle is reached. When a given coil spring 16 is further compressed or loaded, the adjacent coil springs 16 will be compressed along with it. The more coil springs 16 that are placed under compression for a given load, the greater the resistance to that load will be; the spring assembly 12 will have a greater degree of firmness.

The inner diameter of the encircling cross helical 22 and the dimensions of the offset segments 26 define the maximum angle of deflection when the encircling cross helical 22 is also the restricting means. As described above, upon loading of either of the springs 16, i.e., loading to one side of the offset segments 26, the offset segments 26 will move arcuately relative to each other, pivoting about the contiguous pair of first apexes 30*b*. This pivotal movement will eventually be restricted by the encircling cross helical 22 at the points where the cross helical convolutions encircle and catch the offset portions 24. As shown in FIG. 3*a*, the maximum spread between the legs forming the base of the both offset segments 30, 32 is about equal to the pitch of the cross helical 22. The length of the side stabilizing segment 28 is also about equal to the pitch of the encircling cross helical 22. The points of restriction will be about at points p and r. At each of these portions, the overlying and underlying offset portions 24 cannot move any further apart from each other, preventing further pivotal movement of the offset portions 24 relative each other. The maximum angle of deflection between the offset planes is reached. The same limiting effect is had when loading is between the springs 16, and pivotal movement about the contiguous pair of second apexes 32*b* is restricted.

The spring assembly 12 thus has the desirable degree of conformation to a reclined body because of the hinging action between adjacent coil springs 16. The spring assembly 12 also has a greater degree of firmness. A similar assembly that does not have offset portions 24 formed with offset segments 26, for instance a U-shaped offset portion, would be substantially less firm. The optimum firmness is provided without the expense of increasing the coil count of the assembly 12 or the stiffness of the individual coil springs 16, and without sacrificing the desired degree of spring conformation to the shape of a supported body.

The preferred maximum angle of deflection is from about 0° to about 15°. The angle chosen would, however, depend upon the degree of firmness desired and the other variables contributing to the firmness of the assembly 12. A preferred coil spring 16, as shown in FIGS. 2 and 3, with offset portions that extend 1 to $1\frac{1}{4}$ inches from end-to-end (base line), would have first and second offset segments 30, 32 extending approximately $\frac{1}{4}$ inch from this base line.

Figure 9:
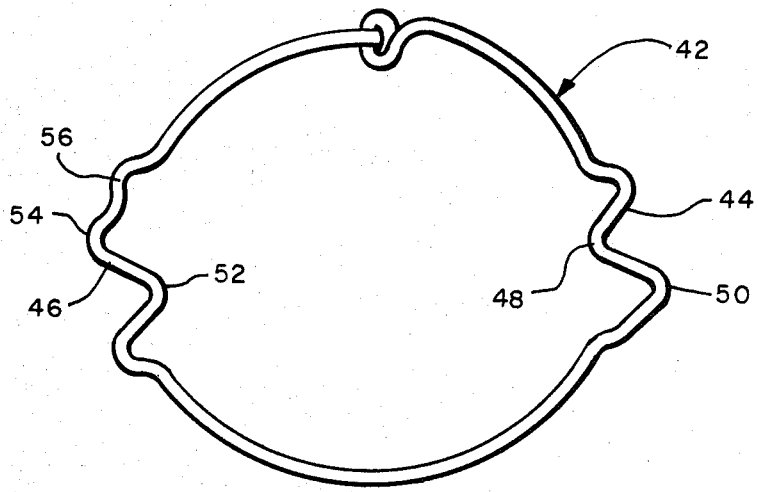
FIG. 9 is a top plan view of a coil spring of the innerspring unit of FIG. 1.

In another preferred embodiment, illustrated in FIG. 9, the opposed offset portions of a coil spring 42 differ in conformation from one another. This preferred coil spring 42 has a first and a second offset portion 44, 46 of different lengths. The first offset portion 44 has a first and a second offset segment 48, 50 but substantially no side stabilizing member. The second offset portion 46 has a first and second offset segment 54, 52 plus a side stabilizing member 56 adjacent the first offset segment 54. The second offset portion 46 is about 25% longer than the first offset portion 44.

An even more preferred embodiment is shown in FIGS. 10 and 11. In each pair of interconnected springs 60, a first offset portion 62 overlies a second offset portion 64. The first offset portion 62 is formed of a first offset segment 66 (jutting towards its coil spring 60 relative to the encircling cross helical 56). The first offset segment 66 leads into a middle stabilizing segment 68 which in turn leads into a second offset segment 70 (disposed opposite its coil spring 60 relative to the encircling cross helical 56). The second offset segment 70 leads, in turn, into a side stabilizing segment 72.

The second offset portion 64 also has a first offset segment 74, forming with the first offset segment 66 of the first offset portion 62 a pair of contiguous apexes 66*b*, 74*b*. A middle stabilizing segment 76 is disposed between the first offset segment 66 and a second offset segment 78. The second offset segment 78 forms, with the second offset segment 70 of the first offset portion 62, a pair of contiguous apexes 70*b*, 78*b*. The second offset portion 64 has a second side stabilizing member 80 adjacent the first offset segment 74, opposite its middle stabilizing segment 76.

The points where the encircling cross helical 56 restricts pivotal movement about either of the pairs of contiguous apexes 66*b*, 74*b* or 70*b*, 78*b* are about at the first side stabilizing member 72, at the middle stabilizing segments 68, 76, and at the second side stabilizing segment 80. Again, the maximum spread of the offset segments 66, 70, 74, 78 and the length of the stabilizing segments 68, 72, 76, 80 are about equal to the pitch of the encircling cross helical 56.

This more preferred embodiment has been found more stable than those described above. The offset portions 62, 64 are restricted at more points and thus have less tendency to slip past each other than the other embodiments described above.

This more preferred embodiment has been found to be more durable. After the maximum angle of deflection is reached, further loading places increasing forces at the points of restriction and at the particular pair of contiguous apexes acting as the pivot point. For a given offset portion, forces acting at restriction points are opposite that at the apex of the contiguous pair of apexes forming the pivot point, creating a bending moment. Providing three restriction points along a given offset portion reduces the length of the offset portion that must resist the bending moment and therefore increases the offset portion's durability.

The configurations of offset portions illustrated and described herein are considered the preferred configurations, although other configurations may be envisioned which would provide the restricted spring hinging action of the present invention. Moreover, the invention has been described and illustrated for a spring assembly wherein all of the interconnected, adjacent coil springs have offset portions formed with offset segments, in both the upper and lower surfaces of the assembly. This construction may, however, be provided only in a portion of the assembly where a controlled degree of spring conformation and firmness is desired. The construction of any given spring assembly may also be varied as to maximum angle of deflection in various portions of the assembly, so as to provide different degrees of spring conformation and firmness to different portions of a mattress or other innerspring unit into which it is incorporated.

Moreover, any means, such as a clip, helix, tie wire or the like that restricts to a maximum the distance between offset portions at the restriction points disclosed above, or their equivalents, are restricting means within the present invention.

It will be understood that changes may be made in the details of construction, arrangement and operation without departing from the spirit of the invention, particularly as defined in the following claims.

I claim:

1. A spring assembly for an innerspring unit comprising:

a plurality of spiral coil springs arranged in a plurality of substantially parallel rows, each of said coil springs having opposed terminal convolutions, said opposed terminal convolutions forming first and second opposed surfaces of the assembly, said terminal convolutions including first terminal convolutions and second terminal convolutions;

said coil springs including a plurality of first coil springs each having a first terminal convolution and a plurality of second coil springs each having a second terminal convolution, said first and second coil springs being disposed adjacent each other in the same row and said first and second terminal convolutions being disposed in the first surface of the assembly;

said first and second terminal convolutions each comprising a first and a second offset segment, each offset segment lying in the plane of its respective terminal convolution and each having a base and an apex, said base being formed of two legs diverging from said apex, and said terminal convolutions being disposed, so that the offset segments of said first terminal convolution overlie the offset segments of said second terminal convolution such that the respective first and second offset segments lie in opposed planes substantially parallel to the first surface, and said apexes of said first offset segments form a first pair of apexes and said apexes of said second offset segments form a second pair of apexes;

said bases of said first and second offset segments of each of said first and second terminal convolutions being disposed in an alignment transverse said rows of coil springs, and said first and second pairs of apexes being disposed on opposite sides of said alignment; and a cross helical, directly interconnecting the offset segments of said first and second terminal convolutions with one another, said offset segments and said cross helical substantially by themselves cooperating together to allow substantially unrestricted pivotal movement between said first and second terminal convolutions to a desired maximum angle upon compressive movement of said first coil spring by a load applied at the first surface of the assembly toward the second surface of the assembly, and to prevent said pivotal movement beyond said desired maximum angle upon further compressive movement of said first coil spring by said load.

2. The spring assembly of claim 1 wherein said first pair of apexes are disposed on the same side of said cross helical as said first terminal convolution.

3. The spring assembly of claim 2 wherein each of said first and said second terminal convolutions are formed with a leg of said first offset segment terminating at a leg of said second offset segment and the maximum spread between said legs of each of said offset segments being substantially about equal to the pitch of said encircling cross helical.

4. The spring assembly of claim 3 wherein at least one of said first and second terminal convolutions is formed with a side stabilizing segment disposed within the circumference of said encircling cross helical and outboard of the end of said alignment of bases.

5. The spring assembly of claim 1 wherein the maximum spread between said legs of each of said offset segments of each of said first and second terminal convolutions is substantially about equal to the pitch of said cross helical.

6. The spring assembly of claim 5 wherein said first and second terminal convolutions are each formed with a middle stabilizing segment between said first and said second offset segment, said middle stabilizing segment being disposed aligned with the principal axis of said encircling cross helical.

7. The spring assembly of claim 6 wherein at least one of said first and second terminal convolutions are formed with a side stabilizing segment disposed outboard of the end of said alignment of base ends and within the circumference of said encircling cross helical.

8. The spring assembly of claim 7 wherein each of said middle and side stabilizing segments are at least of a length substantially about one pitch of said encircling cross helical.

9. A spring assembly for an innerspring unit comprising:

a plurality of spiral coil springs including first and second adjacent coil springs;

each of said first and second coil springs being formed with at least one terminal convolution, said terminal convolutions together forming a surface of the assembly, the terminal convolutions of each of said first and second springs having respectively a first and a second offset portions;

each said first offset portion overlying each said second offset portion such that the respective first and second offset portions lie in opposed planes substantially parallel to the surface of the assembly;

said first and second offset portions each being formed with first and second offset segments, each offset segment forming an apex and each offset segment lying in the plane of its respective terminal convolution, said apexes of said first offset segments meeting at a first pivot point and said apexes of said second offset segments meeting at a second pivot point; and a cross helical, interconnecting said first and second offset portions along their length, said cross helical cooperating directly with said first and second offset portions to allow said first and said second offset portions to freely pivot about said first and second pivot points to a maximum angle of deflection upon compressive movement of the springs and, substantially solely by said direct cooperation of the cross helical with said first and second offset portions, to prevent said first and said second offset portions from pivoting about said first and said second pivot points beyond a maximum angle of deflection upon further compressive movement of the springs when a load is applied to the surface of the assembly in a direction of the coil springs.

10. The spring assembly of claim 9 wherein the cross helical encircles said first and second offset portions along their length encircling at least two offset segments.

11. The spring assembly of claim 9 wherein said first and second pivot points lie to opposite sides of the circumference of said cross helical.

12. The spring assembly of claim 11 wherein said first pivot point lies to the same side of said cross helical as the terminal convolution of said first offset portion, wherein upon loading of one of said first and second coil springs, said first and second offset portions pivot about said first pivot point, and wherein upon loading between said first and second coil springs, said first and second offset portions pivot about said second pivot point.

13. A spring assembly for an innerspring unit comprising:

a plurality of first and second spiral coil springs arranged in a plurality of substantially parallel rows, each of said coil springs having opposed terminal convolutions, said opposed terminal convolutions forming opposed first and second surfaces of the assembly, said terminal convolutions including first terminal convolutions and second terminal convolutions;

said first coil springs each having opposed first terminal convolutions and said second coil springs each having opposed second terminal convolutions, said first and second terminal convolutions being disposed adjacent each other on each of said opposed surfaces in each row;

said first and second terminal convolutions each comprising a first and second offset segment, each offset segment lying in the plane of its respective terminal convolution and each having a base and an apex, said base being formed of two legs diverging from said apex, said offset segments being formed, and said terminal convolutions being disposed, so that the offset segments of said first terminal convolutions overlie the offset segments of said second terminal convolution such that the offset segments of the respective first and second terminal convolutions lie in opposed planes substantially parallel to at least one of said opposed surfaces along substantially the whole length of said offset segments of said first and second terminal convolutions, said legs of the offset segments of the first terminal convolution being contiguous with said legs of the offset segments of the second terminal convolution and said apexes of the first terminal convolution being contiguous with said apexes of the second terminal convolution, whereby said apexes of said first offset segments form a first pair of overlying apexes and said apexes of said second offset segments form a second pair of overlying apexes;

said bases of said first and second offset segments of each of said first and second terminal convolutions being disposed in an alignment traverse said rows of coil springs, and said first and second pairs of apexes being disposed on opposite sides of said alignment; and a cross helical cooperating directly with said first and second offset portions to allow substantially unrestricted pivotal movement of said offset segments about said first and second pairs of apexes to a desired maximum angle of deflection between said first and second terminal convolutions upon compressive movement of said first coil springs, by a load applied from the direction of the first surface of the assembly to the second surface of the assembly, and, substantially solely as a result of said direct cooperation of the cross helical with said first and second offset portions, to prevent pivotal movement of said terminal convolutions about said first and second pairs of apexes beyond the desired maximum angle of deflection upon further compressive movement of said first coil springs by a load applied from the direction of the first surface of the assembly to the second surface of the assembly.

14. A spring assembly for an innerspring unit comprising:

a plurality of spiral coil springs including first and second adjacent coil springs;

each of said first and second coil springs being formed with at least one terminal convolution forming an assembly surface, the convolutions of said first and second springs having respectively a first and a second offset portion;

each said first offset portion overlying each said second offset portion;

said first and second offset portions each being formed with first and second offset segments extending in opposite directions relative to one another, said first offset segment of said first offset portion overlying said first offset segment of said second offset portion along substantially their whole length and said second offset segment of said first offset portion overlying said second offset segment of said second offset portion along substantially their whole length such that the respective first and second offset segments lie in opposed planes substantially parallel to the assembly surface, each offset segment forming an apex and each offset segment lying in the plane of its respective terminal convolution, said apexes of said first offset segments meeting at a first pivot point and said apexes of said second offset segments meeting at a second pivot point, said pivot points not lying on the same pivotal axis; and a cross helical for preventing pivotal movement between said first and second offset portions about said first and said second pivot points beyond a maximum angle of deflection between said first and second offset portions, said offset portions and said cross helical directly cooperating to allow substantially unrestricted pivotal movement between said terminal convolutions of said first and second coil springs to the maximum angle of deflection upon compressive movement of said first coil spring by a load applied at the assembly surface in the direction of the coil springs, and cooperating substantially by themselves to prevent said pivotal movement beyond the maximum angle of deflection upon further compressive movement of said first coil spring by said load to form a rigid connection between said terminal convolutions so that said first and second coil springs both support the load.

15. The apparatus of claim 1 or 9 or 13 or 14 wherein the maximum angle is such that said spring assembly substantially conforms to the shape of a body reclining thereupon yet provides substantially firm support for said body.

* * * * *